United States Patent [19]

Yamamoto

[11] Patent Number: 4,652,029

[45] Date of Patent: Mar. 24, 1987

[54] LOCKING MECHANISM FOR A CASE

[76] Inventor: Ken Yamamoto, 22-5, 4 Chome Nishisakado, Sakado-shi, Saitama ken, Japan

[21] Appl. No.: 646,363

[22] Filed: Aug. 30, 1984

[30] Foreign Application Priority Data

Oct. 28, 1983 [JP] Japan ..... 58-203557
Jun. 21, 1984 [JP] Japan ..... 59-103529

[51] Int. Cl.[4] ..... E05C 15/00
[52] U.S. Cl. ..... 292/252
[58] Field of Search ..... 292/23, 106, 129, 218, 292/231, 238, 252, 302, 193; 70/289

[56] References Cited

U.S. PATENT DOCUMENTS 530,862 12/1894 Teed ..... 70/289 X
680,282 8/1901 Scheloske ..... 206/1.5
2,399,302 4/1946 Thiele ..... 292/106 X
2,659,228 11/1953 Ducharme ..... 70/289 X
3,537,741 11/1970 Boyriven ..... 292/252 X
3,828,899 8/1974 Scott ..... 292/231 X
4,346,924 8/1982 Herriott ..... 292/129

*Primary Examiner*—Richard E. Moore
*Attorney, Agent, or Firm*—Donald D. Mon; David O'Reilly

[57] ABSTRACT

An automatic locking mechanism for a case in which a container having an inclined surface and a ball is mounted along one side of the case and hooks are mounted on the other opposing side. The hooks engage an opening in the container when the two sides of the container are brought together. The hooks also have an inclined surface matching the inclined surface in the container to allow the ball to roll along the inclined surface to a position wedged between the hooks and container when the case is in a vertical position. Laying the case flat or horizontally causes the ball to roll along the inclined surface away from the hooks thereby releasing and unlocking the case.

10 Claims, 9 Drawing Figures

LOCKING MECHANISM FOR A CASE

FIELD OF THE INVENTION

This invention relates to a locking mechanism for a case as an attache case, business case, clothing case, tool box, dressing case, vanity case, or the like and particularly to a locking mechanism, for a lid provided between a body and the lid.

BACKGROUND OF THE INVENTION

Prior art cases are shown generally in FIGS. 1, 2*a* and 2*b*.

A perspective view illustrating an example of a case providing a conventional lid locking mechanism is shown in FIG. 1 in which a case body 1, having a lid 2 is pivoted along its lower edge by hinge shown at 3 in FIG. 5 so it can open and close freely. A lid locking mechanism 4 is provided on opposite sides at the middle portion of the lateral face of case 1 and lid 2. Handle 22 is provided at the center of the upper face of case 1.

An auxiliary lid 5 is pivoted at an upper edge of lid 2 through hinge shown at 6 in FIGS. 3 and 4. An auxiliary locking mechanism for auxiliary lid 5 is provided on opposite sides of the upper face of the case.

Locking mechanism 4 and auxiliary locking mechanism 7 comprise base member 9 having engaging hole 8 attached to the inner face of case 1 as shown in FIG. 2. Base plate 12 has a slot 11 in communicating with hole 1*a* in case 1, cooperates with hook 10 and rotating member 16 pivotally attached to end of base plate 12 by hinge 13 biased against spring 14. Rotating member 16 has pin 15 engaging slot 11 through hole 1*a* when it is rotated against the resilient force of spring 14. Operating part 19 mounted in rotating member 16 is slidably biased by spring 17 has an engaging hole 18 to engage and disengage from hook 10 when operating part 19 is pressed against the resilient force of compression spring 17. Locking member 21 having engaging hole 20 is reamed to lid 2 or auxiliary lid 5 to enter engaging hole 8 to engage with pin 15 as shown in FIGS. 3 and 4.

In a conventional case, auxiliary locking mechanism 7 is released with the case in the upright state as shown in FIG. 1, by pressing operating parts 19,19 toward the center as shown by arrows in FIG. 1 against the force of springs 17,17. Engaging hole 18,18 disengages from hooks 10,10, allowing rotating member 16,16 to rotate upwardly by the force of springs 13,13. Pins. 15,15 disengage from holes 20,20 of locking members 21,21 as shown in FIG. 1*a*.

In this position, it is possible to remove a magazine, newspaper or umbrella from the case without opening the lid completely by simply opening auxiliary lid 5. Thus, it is possible to take out an umbrella, magazine or newspaper from the case while holding it by one hand while standing in a car (tram car) or by setting the case on the floor in an upright position.

Closing auxiliary lid 5, causes locking members 21,21 to engage holes 8,8 in base members 9,9. Then by pressing rotating member 16 downwardly against the force of spring 14, the edge of engaging hole 18 encounters the upper tapered face of hook 10, allowing operating part 19 to slide toward the center against the force of spring 17 which slides outwardly so that hook 10 enters hole 18 to engage operating part 19 to a locked position as shown in FIGS. 1 and 2*b*.

It is also possible to release locking mechanism 4 with case 1 in a horizontal position by pressing operating parts 19,19 of locking mechanism 4,4 in the direction shown by arrows in FIG. 1 against the resilient force of compression springs 17,17. This causes the engagement between pin 15 of rotating member 16 and hole 20 of locking member 21 to be released as explained above with respect to the auxiliary locking mechanism 7,7.

Lid 2 along with auxiliary lid 5 rotate outwardly about hinge 3, to completely open the case as shown in FIG. 4. In this condition access to all the articles in the case for removal is permitted. It is possible to remove or replace articles in the case by opening and closing auxiliary lid 5 and lid 2 together or auxiliary lid 5 alone as explained above.

In any event the locking mechanism of a conventional case is complicated and expensive in construction and operation because it uses base member 9 having engaging hole 8, base plate 12 having hook 10 and slot 11, rotary member 16 having pin 15, hinge 13 having spring 14, operating part 19 having engaging hole 18 and compression spring 17 and locking member 21 having to engage hole 20.

BRIEF DESCRIPTION OF THE INVENTION

The object of this invention is to improve and avoid above mentioned drawbacks by providing a locking mechanism for a case which is both simple and small in construction having fewer parts for ease of manufacture at low cost without the necessity of a locking operation or releasing operation for opening or closing the lid. More particularly the locking mechanism is released automatically by placing the case in a horizontal position and automatically locked by placing the case in a vertical position.

The object of this invention is to provide a lid locking mechanism comprised of a hook, a container having an opening, a guide member having a guiding face in the container, and a ball.

DETAILED DESCRIPTION OF THE INVENTION

Figure 1:
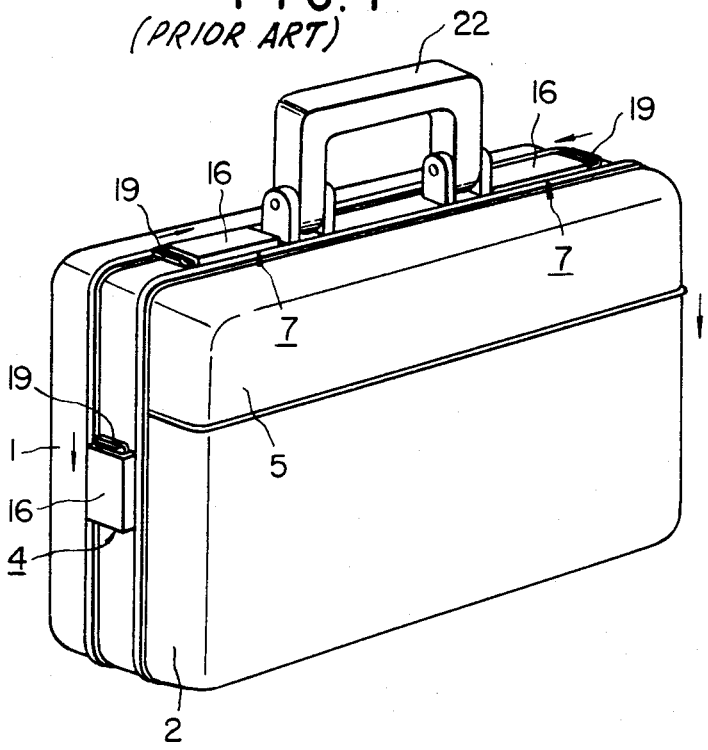
FIG. 1 (PRIOR ART)
FIG. 1 is a perspective view of an attache case having a conventional (prior art) lid locking mechanism.
Figure 2A:
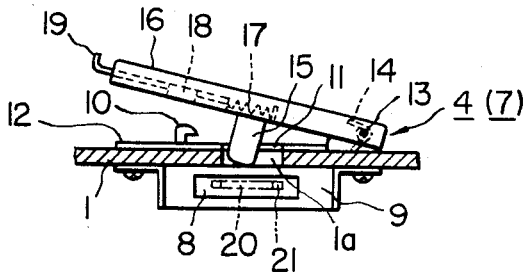
FIG. 2(a) (PRIOR ART)
FIG. 2*a,b* are cross sectional view of the conventional (prior art) lid locking mechanism of FIG. 1 showing it in a released state and in a locked state respectively.
Figure 2B:
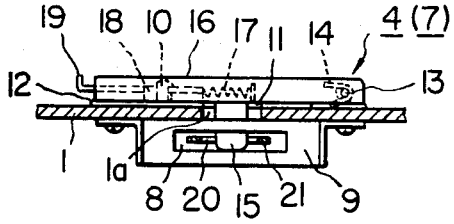
FIG. 2(b) (PRIOR ART)
Figure 3:
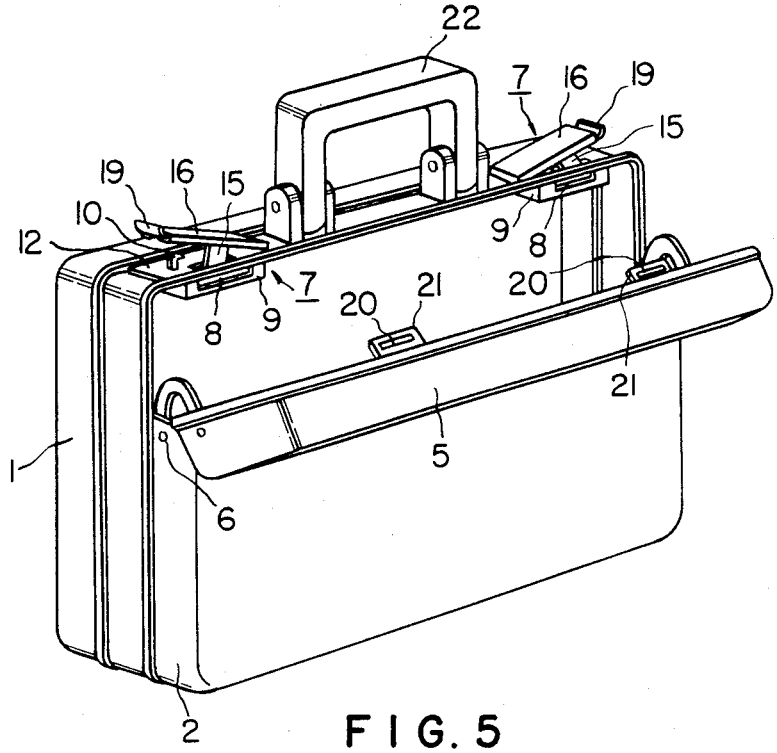
FIG. 3 is a perspective view of one embodiment of an attache case having a conventional locking mechanism and a locking mechanism according to the invention with only the auxiliary lid being open.
Figure 5:
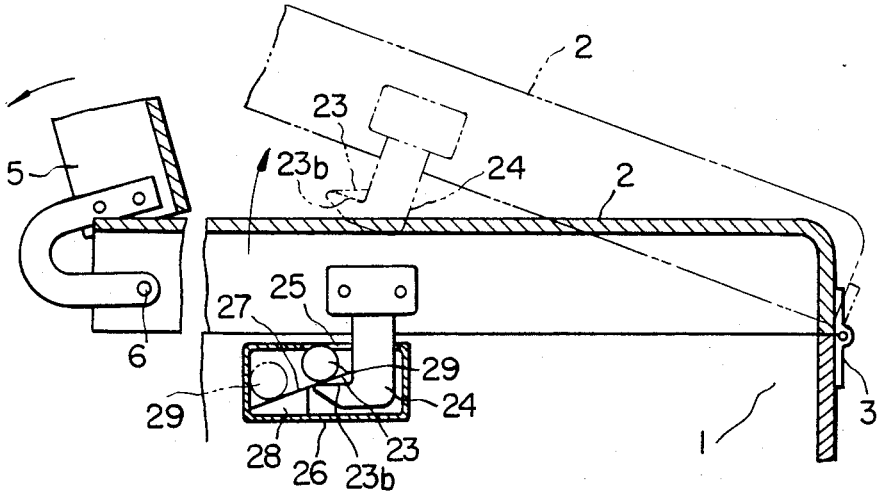
FIG. 5 is a cross-sectional view of a locking mechanism constructed according to the invention.
Figure 4:
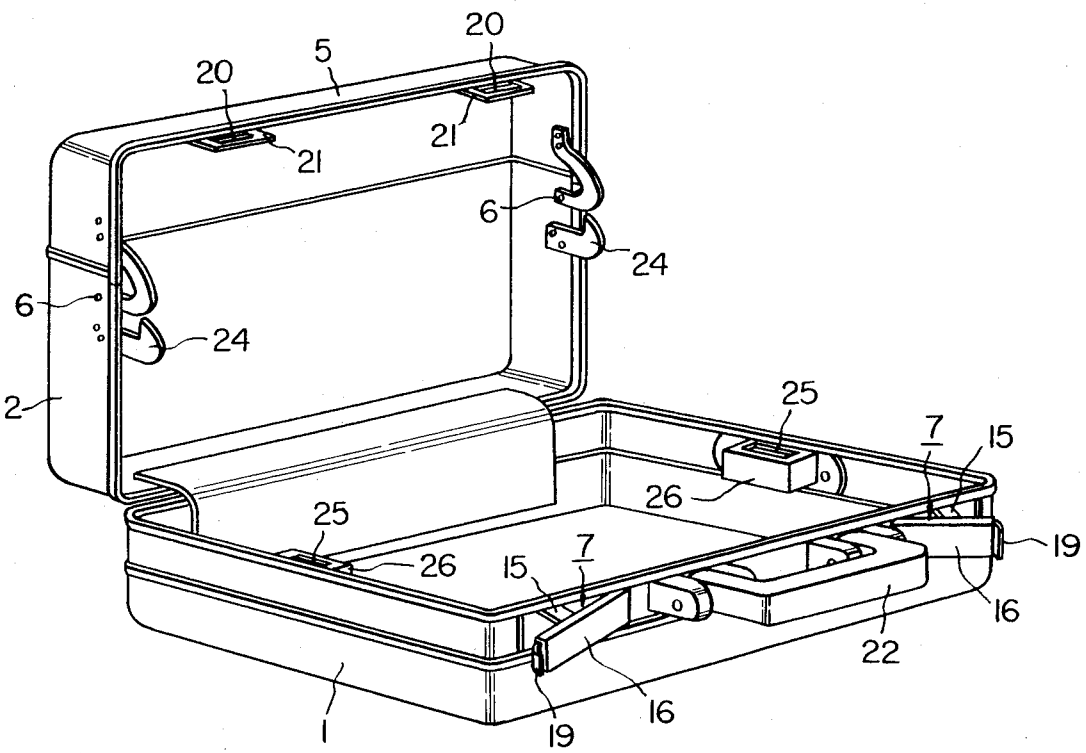
FIG. 4 is another perspective view of the attache case of FIG. 3 with the lid completely open.

One embodiment of the invention is shown in FIGS. 3 through 5 in which same parts as those of the conventional case of FIGS. 1 and 2 have the same reference members. In this embodiment, the locking mechanism according to the invention is applied to main lid 2. The locking mechanism comprises hook 24 (FIG. 5) having an inclined face 23 angling downwardly toward its end. Container 26 attached to the inner face of case 1 has opening 25 for insertion of hook 24, and guide member 28 whose guide face 27 is aligned with inclined face 23 of hook 24 when the hook is inserted into container 26 through opening 25. A ball 29 is permitted to roll on the incline of face 23 and guide face 27 when the case is moved from a vertical position to a horizontal position.

Operation of this embodiment is as follows:

As shown in FIG. 3, it is possible to remove or replace small articles such as a newspaper, magazine or umbrella etc. by opening auxiliary lid 5 as explained above with respect to a conventional case.

To open main lid 2 with auxiliary lid 5 completely, for removing other articles, case 1 is placed in a horizontal position as shown in FIGS. 4 and 5, so that ball 29 can roll on inclined face 23 of hook 24 and guide face 27 of guide member 28 downward to a position shown in the dotted lines in FIG. 5, thus releasing the lock between hook 24 and container 26.

Otherwise, auxiliary locking mechanism 7 on the right and left sides of the case are released as explained previously.

Main lid 2 and auxiliary lid 5 may be opened by an outward rotation about hinge 3, with auxiliary lid 5 opened simultaneously (FIGS. 4 and 5). Thus all articles contained in case 1 are accessible.

For receiving articles, they are placed in case 1, main lid 2 and auxiliary lid 5 are closed and auxiliary lid 5 is locked by auxiliary locking mechanism 7. Then the case is brought to a vertical position, ball 29 rolls along inclined guide face 27 of guide member 28 and inclined face 23 of hook 24, and to the position shown by the solid line in FIG. 5, in engagement with hook 24 and container 26. As a result, main lid 2 is locked.

The positions of hook 24 and container 26 may be varied. They may be attached to the outer face on opposite sides of the case 1 and main lid 2 if desired.

It is also possible to apply this invention to a case which has a main lid only. For this case, the locking mechanism can be provided on the upper face of the case, however the locking mechanism must then be released with the case in a vertical position as shown in FIG. 1.

Figure 6:
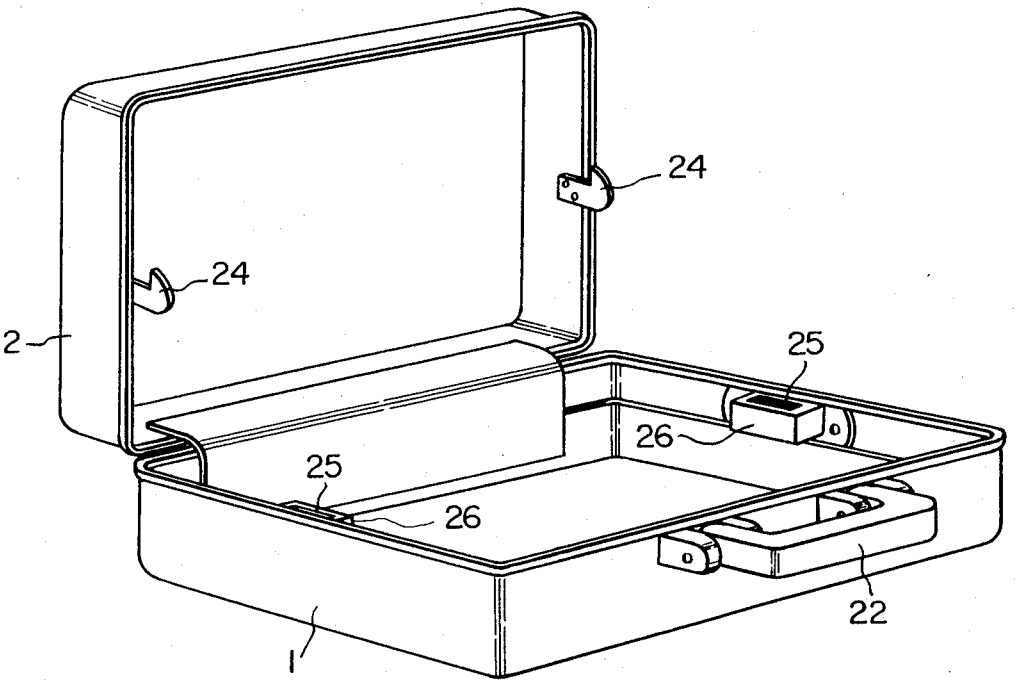
FIG. 6 is a perspective view of another embodiment of the invention with the lid completely open.

Another embodiment of the invention in which the case has only one lid is shown in FIG. 6. In this embodiment, a roller having a circular column shape may be substituted for ball 29.

Figure 7:
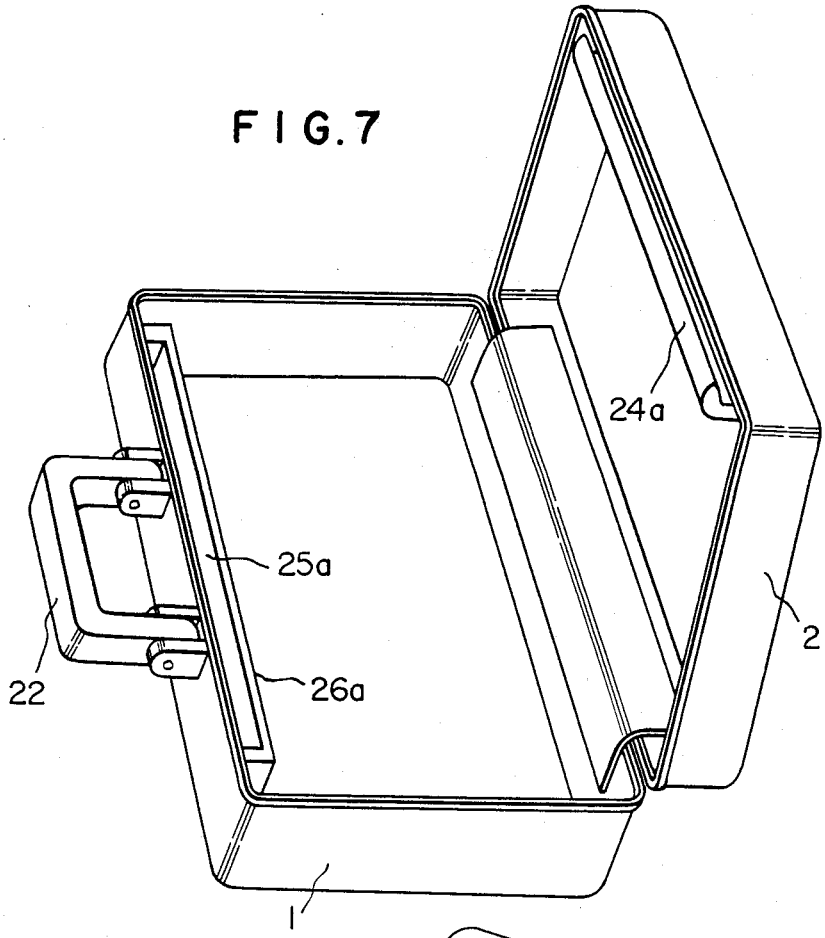
FIG. 7 is a perspective view of yet another embodiment of the invention with the lid completely open.
Figure 8:
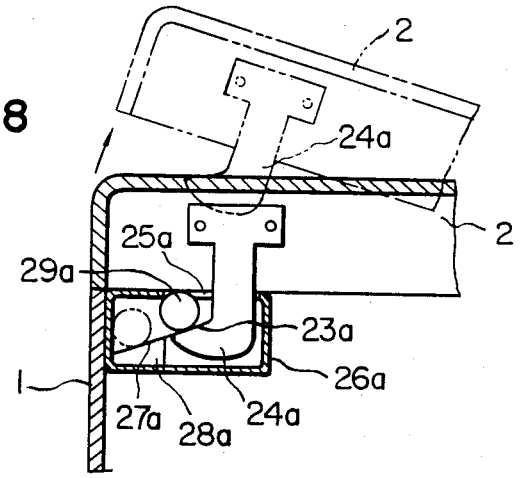
FIG. 8 is a cross sectional view of the locking mechanism of the embodiment shown in FIG. 7.

Still another embodiment of the invention is shown in FIGS. 7 and 8 in which like parts have like reference members of previous embodiments with an "a" added. A wide hook **24*a* extends along the width of case 1 and is attached to either case 1 or main lid 2. Rectangular shaped container 26*a* is attached and extends along the width of either case 1 or main lid 2. Container 26*a* has an elongate opening 25*a* for receiving hook 24*a*. As shown in FIG. 8 container 26*a* has an elongate guide member 28*a* having an elongate guide face 27*a* matching elongate inclined face 23*a* of hook 24*a* when inserted into container 26*a* through said opening 25*a*. Roller 29*a* having circular column or rod-like shape is positioned in container 26*a* so as to roll on inclined guide faces 27*a* and 23*a* into engagement with hook 24*a* in container 26*a* when case is in the vertical position. Operation of this embodiment is almost the same as in the embodiment shown in FIGS. 3, 4 and 5**.

In this invention, the locking mechanism should lock the case and lid when case 1 is in the vertical position. Therefore, guide faces 27,**27*a* of guide member 28,28*a* and inclined faces 23,23*a* of hooks 24,24*a* need not be inclined faces but may be a simple plane as shown in dotted line 23*b* of FIG. 5**.

As explained above, in this invention, the number of parts is less than a conventional case because it contains only a hook, a container having an opening and guide faces and a ball or a columnar or rod-like roller. The locking mechanism locks automatically when the case is in a vertical position and releases automatically when the case is in a horizontal position so that operation of the locking mechanism is very simple and easy to use. A locking mechanism according to this invention can be attached to an inner face of the case so that the design of a case may be freely selected.

I claim:

1. A case having a case body and a lid pivoted at a lower edge of said body, said case having a locking mechanism comprising; a hook attached to either said case body or lid, a container having an opening for receiving said hook attached to the other of said case body or said lid, said container having a roller which rolls on a guide face in said container in communication with a guide face on said hook when said hook is inserted into said container through said opening; an auxiliary lid pivotally attached adjacent an upper end of said lid, said locking mechanism of container and hook being provided on respective lateral faces of said case body and lid and an auxiliary locking mechanism provided on an upper face of said case body.

2. A locking mechanism for a case as claimed in claim 1 including a guide member having said guide face secured in said container.

3. A locking mechanism for a case as claimed in claim 1 in which said roller is a substantially cylindrically shaped rod.

4. A locking mechanism for a case body as claimed in claim 3 in which said hook, said container opening and said roller are elongated in shape extending along the width of the case.

5. An automatic locking mechanism for a case comprised of a pair of members hinged along one side comprising;

hook means attached to one of said pair of members;

hook receiving means attached to the other of said pair of members;

said hook receiving means having an opening for insertion of said hook means when said pair of members are brought together;

an inclined surface formed an interior surface of said hook receiving means;

roller means retained in said hook receiving means on said inclined surface arranged to roll to one end of said inclined surface when said case is in a first position and to roll to the other end of said inclined surface when said case is in a second position;

auxiliary lid means, hingedly connected to one of said members at an upper end spaced from said hinge connecting said members; and an auxiliary locking mechanism on said auxiliary lid and the other of said members for locking said auxiliary lid to said other member; said roller means when at said one end of said inclined surface being wedged between said hook receiving means and said hook means thereby locking said case and when at the other end of said inclined surface being disengaged from said hook means thereby unlocking said case whereby said case may be locked and unlocked by a simple change from one position to another.

6. The mechanism according to claim 5 in which a hook portion on said hook means has an inclined surface substantially corresponding to the inclined surface on said hook receiving means.

7. The mechanism according to claim 6 in which said auxiliary locking mechanism is independent of said automatic locking mechanism whereby said auxiliary lid may be opened to provide access to articles without opening said pair of members.

8. The mechanism according to claim 6 in which said auxiliary locking mechanism comprises a conventional snap-lock mechanism mounted on said other of said members.

9. The mechanism according to claim 6 in which said hook receiving means extends substantially entirely across said one of said pair of members, and said hook means extending substantially across the other of said pair of members.

10. The mechanism according to claim 2 in which said roller means comprises a substantially cylindrical elongate rod.

* * * * *